US005095810A

United States Patent [19]

Robinson

[11] Patent Number: 5,095,810

[45] Date of Patent: Mar. 17, 1992

[54] ROOF RIDGE VENTILATION SYSTEM

[75] Inventor: Larry D. Robinson, Taylorsville, Miss.

[73] Assignee: Enamel Products and Plating Co., McKeesport, Pa.

[21] Appl. No.: 643,223

[22] Filed: Jan. 22, 1991

[51] Int. Cl.[5] ..... F24F 7/02

[52] U.S. Cl. ..... 454/365; 454/366; 454/367

[58] Field of Search ..... 52/199; 98/42.21, 42.22

[56] References Cited

U.S. PATENT DOCUMENTS

| | | | |
|---|---|---|---|
| 3,236,170 | 2/1966 | Meyer et al. | 98/42.21 |
| 3,660,955 | 5/1972 | Simon | 98/42.21 X |
| 4,073,106 | 2/1978 | Malott | 52/199 |
| 4,090,435 | 5/1978 | Vallée | 98/42.21 |
| 4,280,399 | 7/1981 | Cunning | 98/42.21 |
| 4,676,147 | 6/1987 | Mankowski | 98/42.21 |
| 4,782,743 | 11/1988 | Quinel | 52/199 X |
| 4,817,506 | 4/1989 | Cashman | 98/42.21 |
| 4,843,953 | 7/1989 | Sells | 98/42.21 |
| 4,903,445 | 2/1990 | Mankowski | 98/42.21 X |
| 4,924,761 | 5/1990 | MacLeod et al. | 98/42.21 |
| 4,957,037 | 9/1990 | Tubbesing et al. | 98/42.21 |

FOREIGN PATENT DOCUMENTS 2707384 8/1978 Fed. Rep. of Germany ..... 52/199

*Primary Examiner*—Harold Joyce

*Attorney, Agent, or Firm*—Arnold B. Silverman

[57] ABSTRACT

A ridge vent for covering the opening at the peak of a roof. The ridge vent is composed of a first panel portion joined to a second panel portion to form a generally inverted V-shaped web portion which fits over the peak of the roof. The web portion has an interior surface on which a plurality of V-shaped baffles are disposed to support the vent on the roof. The baffles are disposed in an overlapping pattern to resist rain and snow from entering the building. The ridge vent also has ventilation ribs with openings therebetween the ribs extending downwardly from each side of the web portion to allow passage of air into and out of the openings. An angled flange is provided at either side of the ridge vent to deflect air upwardly and over the roof and to create negative air pressure. Alignment tabs and flaps are provided to connect contiguous vent panels together along a roof peak. Nail holes are provided for securing the vent panels to the roof. Another embodiment of the vent is a flashing-type vent for use with half-ridge roofs and the like.

42 Claims, 4 Drawing Sheets

ROOF RIDGE VENTILATION SYSTEM

BACKGROUND OF THE INVENTION

1. Field of the Invention

This invention relates to a ventilation system for covering the opening at the peak of a roof. More particularly, the invention relates to a roof ridge vent assembly including an array of vent panels which are placed in contiguous fashion to cover the peak of a roof to allow for ventilation of air while resisting entry of precipitation, insects, birds and the like.

2. Background Information and Description of the Prior Art

It is often necessary or desirable in constructing buildings to provide for ventilation of attic space or other building space under sloped roofs. These products are generally designed to resist entry of rain, snow, and other precipitation, into the roof while allowing ventilation of the building. In addition, vents are provided to resist insects and birds or other animals from entering the attic opening. A variety of products have been known to perform these functions. However, many such devices require separate construction for each building depending upon the building dimensions and materials to be used. In addition, many such products which have been known are expensive, and are not sturdy enough to withstand prolonged exposure to weather phenomena. In addition, these known products often do not conform to the esthetic features of the building.

U.S. Pat. No. 3,236,170 discloses a ventilated roof construction having a top plate formed into an inverted "V" and having opposite flap legs welded onto the plate which are constructed of corrugated metal sheets. This construction can be costly and not easily adaptable to accommodate various dimensions, such as for example, the angle at which the roof is peaked, as well as the length of the roof of the building.

U.S. Pat. No. 4,676,147 discloses a roof ridge ventilator which comprises a one-piece cover which is angled to conform to the peak of the roof. This ridge vent member is disclosed to be of plastic, however, this reference does not provide for deflecting air upwardly while allowing drainage of moisture from the ridge vent.

U.S. Pat. No. 4,817,506 discloses another type of ventilator for disposition along the roof ridge. The ventilator has a flat bottom surface which directly contacts the roof and does not have a separate drainage gutter or wind-deflection means for facilitating ventilation while resisting moisture build-up.

Various types of corrugated roof ridge ventilators have been known. See generally U.S. Pat. No. 4,280,399 and U.S. Pat. No. 4,843,953.

End-caps and connectors for roof ridge ventilators and other peripheral items were disclosed in U.S. Pat. No. 4,073,106.

In spite of the availability of the foregoing products, there remains a need for an improved device for ventilating space underlying a sloped roof, which at the same time provides for adequate drainage of precipitation or moisture build-up from the ridge ventilator. In addition, there remains a need for an easy-to-use and easily adaptable vent panel which can accommodate buildings with roofs peaked at different angles and various lengths of roof peaks.

SUMMARY OF THE INVENTION

These and other needs have been satisfied by the device of the present invention which provides a roof ridge ventilating system composed of an array of vent panels. Each vent panel is composed of a first panel portion and a second panel portion. The first panel portion is angularly disposed with respect to the second panel portion at a preferred angle of inclusion which is discussed in further detail hereinbelow. The panel portions may be constructed separately and then suitably joined together. Alternatively, in a preferred form, the panel portions are made in a unitary construction which can be initially formed flat and then bent across the roof. In the preferred form, the ridge vent has a variable hinge which allows for the vent to be bent to conform to roof peaks of varying angles. In addition, the three point hinge allows a gradual curve to resist cracking the capping shingles which are placed over the vent. Ventilation members are disposed generally adjacent each side edge of each panel portion of the ridge vent to allow air to circulate into and out of the building space. In addition, an upwardly angled flange is disposed along each ventilation member to direct air upwardly and to facilitate flow of air. A drainage feature may also be integrally formed between the ventilation member and the outwardly extending flange to collect precipitation which runs down the capping shingles which are typically placed over each ridge vent.

The panel portions are supported on the roof by a set of generally V-shaped baffles which are positioned on the underside of each panel portion. The generally V-shaped baffles are placed in a predetermined configuration such that they are spaced apart across the vent, but they overlap along the longitudinal dimension of the vent so that entry of wind driven rain and snow into the building through the ventilation members between the generally V-shaped baffles will be resisted.

Receiving bores are provided at a plurality of locations along each vent panel to provide for support for nails to be driven through the bores into shingles or underlying roof portions.

A system for connecting adjacent ridge vents to one another is provided on each panel of the ridge vent array. This is composed of alignment tabs constructed to frictionally engage corresponding alignment tabs on an adjacent ridge vent. In addition, an extension member may be provided at one end of each ridge vent to cover the alignment tabs. The corresponding set of alignment tabs on the adjacent ridge vent fits underneath the extension member and a smooth surface is created between adjacent ridge vents. The extension member also adds continuous support between ridge vents and closes any gap which exists between two connected ridge vents. The extension member resists entry of moisture from through the gap between the ridge vents.

This system is also provided with end plugs to be used on the endmost ridge vents of the ridge vent array. Pins and slots are provided in each ridge vent to secure the end plug in place. These pins and slots are provided at spaced intervals along each ridge vent such that any ridge vent can be used as the end vent. Furthermore, a ridge vent may be cut so that the system can be adapted for a variety of roof lengths and it is, therefore, not necessary to order a separate product for the end ridge vent.

In accordance with another aspect of the invention, the ridge vent may be used as a flashing-type ridge vent by simply cutting the existing ridge vent along one of the hinges as appropriate to conform to a half-ridge roof, other sloped roof or other exterior building surface.

It is an object of the invention to provide an economical and easy-to-use ventilation system to provide ventilation for attic space or other underlying building space while resisting precipitation, insects, birds and the like from entering the building.

It is another object of the invention to provide uniform ridge vents which can be used on roofs of various lengths and on roofs having peaks which are angled differently.

It is a further object of the invention to provide a plastic ridge vent which resists wear due to weather, resists warping and is not susceptible to deterioration.

It is a further object of the invention to provide a ventilation system which allows for proper drainage of moisture away from the opening in a roof.

These and other objects of the present invention will be more fully understood from the following description of the invention with reference to the illustrations appended hereto:

DESCRIPTION OF THE PREFERRED EMBODIMENTS

Figure 1:
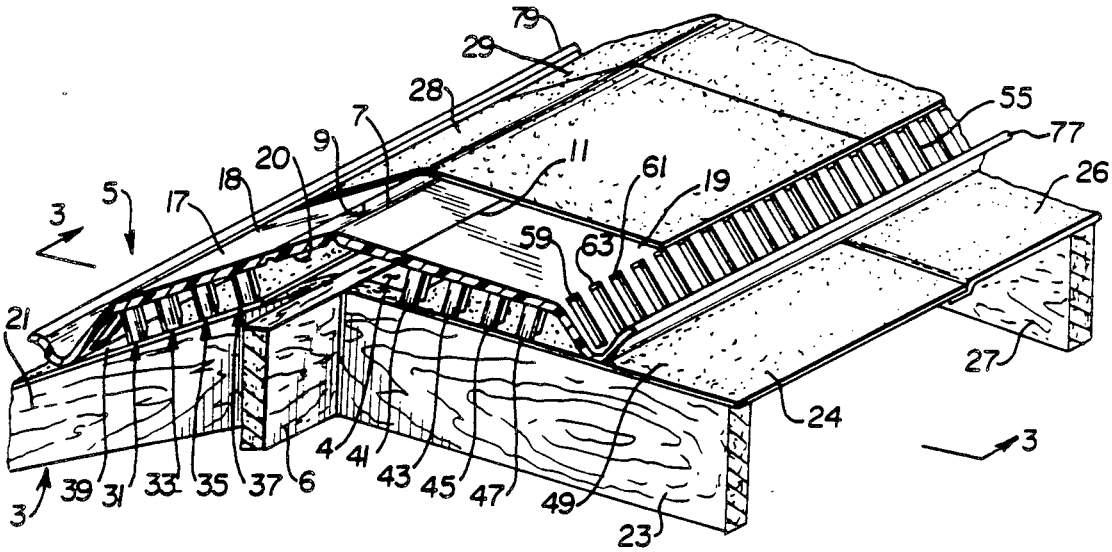
FIG. 1 is an isometric drawing of the ridge vent of the present invention assembled on a roof peak with capping shingles attached to the ridge vent.
Figure 2:
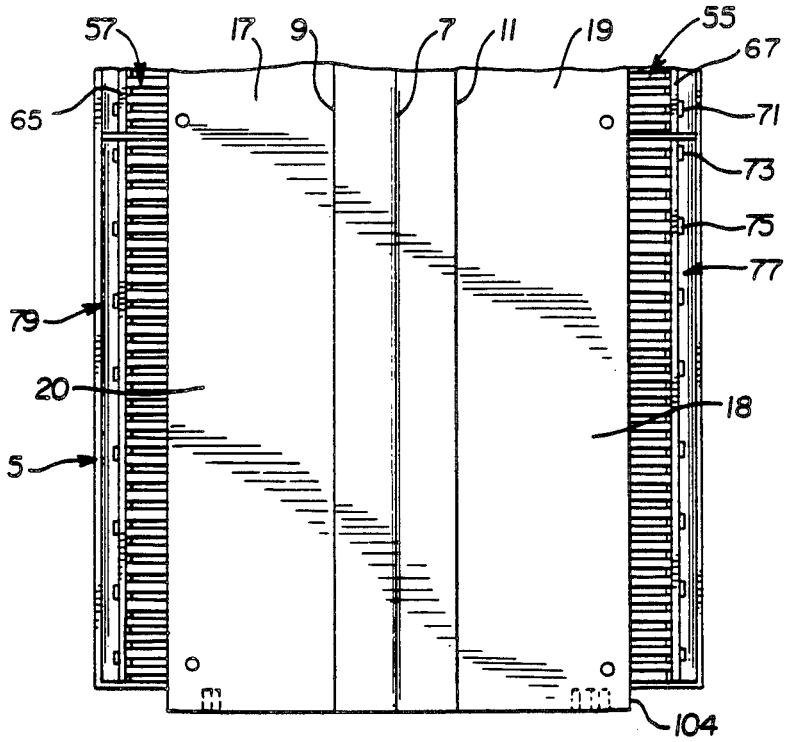
FIG. 2 is a top plan view of the ridge vent of the present invention.
Figure 3:
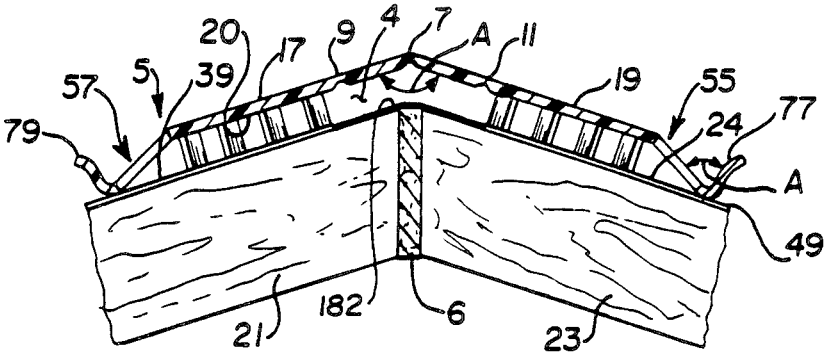
FIG. 3 is a cross-section of the ridge vent of FIG. 1 taken along line 3—3 of FIG. 1.

Referring now to FIGS. 1 through 3, roof portion 3 has opening 4 which is beneath the main beam 6 of the roof 3. Cross-beams such as 21 and 23 are joined to main beam 6 to form the structural support for the roof 3. A plurality of cross-beams exist along the roof at spaced intervals. The cross-beams 21 and 23 and the next cross beam 27 support plywood decking (not visible) onto which shingles such as shingles 24 and 26 are affixed. The shingles 24 and 26 stop short of the main beam 6 so that a gap exists over which the ridge vent of the present invention is placed. More specifically, between each set of cross-beams 21, 23 and 27, openings such as opening 4 exist to allow air to pass into the building space. In accordance with the present invention, ridge vent 5, which is preferably composed of plastic as discussed hereinafter, is placed over the opening 4 in roof 3 in order to allow for ventilation of the underlying space while resisting entry of weather, insects, birds, and the like. Capping shingles 28 and 29 are placed over ridge vent 5 to complete the roof as discussed hereinafter. Ridge vent 5 is composed of panel portion 17 which is angularly disposed with respect to panel portion 19. Panel portions 17 and 19, are, in a preferred form, of unitary construction. More specifically, the entire ridge vent 5 is preferably initially a flat object composed of panel portions 17 and 19 which are then bent at hinges 7, 9 and 11 to conform to the peak of roof 3 and to form a substantially smooth curved surface to support capping shingles 28 and 29. Alternatively, panel portions 17 and 19 may be constructed separately and then joined in an angular configuration.

In the preferred embodiment, panel portions 17 and 19 are a flat unitary piece which can be bent at hinges 7, 9 and 11. Hinges 7, 9 and 11 in the form shown are integrally formed by thinner portions of the panel which are generally downwardly open (FIG. 3.) Hinges 7, 9 and 11 form a three point hinge to allow a gradual curve rather than a sharp angle. Although FIG. 3 shows the bend at hinge 7 to be a distinct angle, it is noted that it may be preferred in the application to provide additional bending at hinges 9 and 11 to form a smoother curve which resists cracking of the overlapping capping shingles, such as shingles 28 and 29. The hinges 7, 9 and 11 are also provided to accommodate use of the ridge vent 5 with roofs having peaks which are angled differently.

Figure 4:
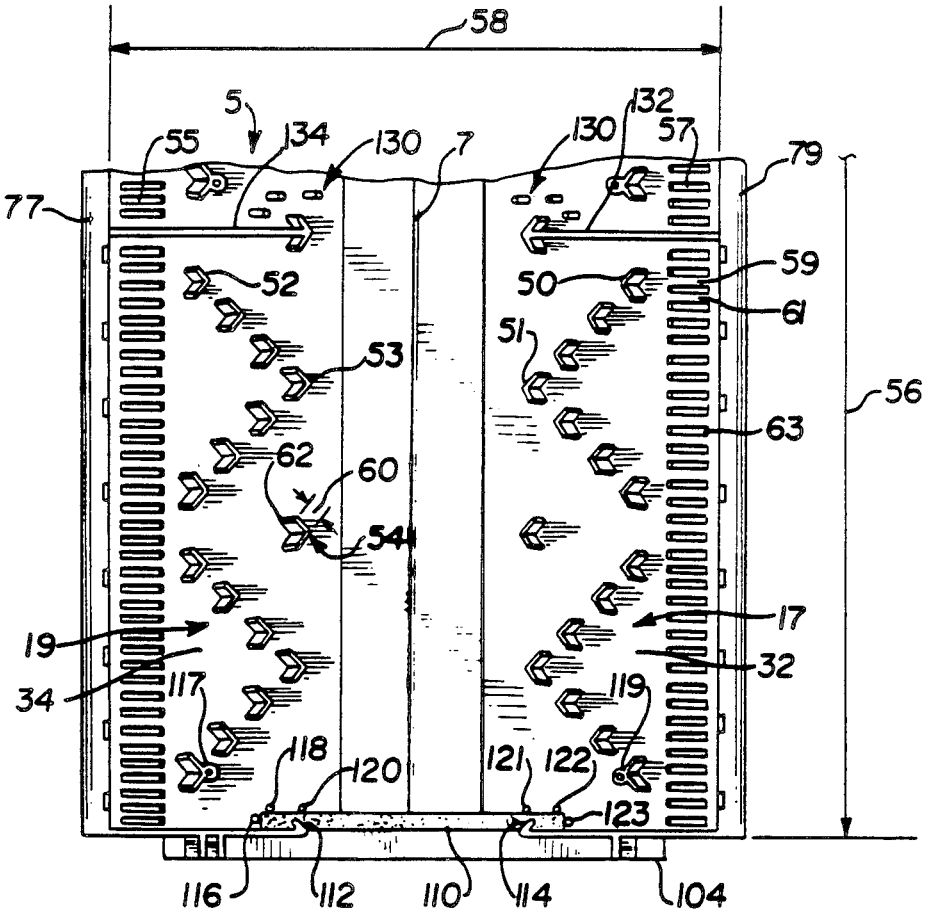
FIG. 4 is a bottom plan view of the ridge vent of FIG. 2.

Panel portions 17 and 19 are composed of cover surfaces 18 and 20, respectively (FIG. 2). Cover surfaces 18 and 20 face towards the atmosphere and the capping shingles 28 and 29 are placed over the cover surfaces 18 and 20 when the roof 3 is completed. Additionally, panel portion 17 and panel portion 19 have interior surfaces 32 and 34, respectively (FIG. 4). Interior surfaces 32 and 34 face into opening 4 in the roof 3.

Panel portion 17 of ridge vent 5 is supported on roof 3 by a plurality of generally V-shaped baffles, such as baffles 31, 33, 35 and 37 which are visible in FIG. 1. Panel portion 19 is similarly supported by a plurality of generally V-shaped baffles, such as baffles 41, 43, 45 and 49 which are visible in FIG. 1. The generally V-shaped baffles 31 through 37 protrude from the underside of panel portion 17 generally along an axis normal to the plane of panel portion 17. Baffles 31 through 37 directly contact with shingles such as shingle 39 of roof 3 and support ridge vent 5 on roof 3. Similarly, generally V-shaped baffles 41 through 49 of panel portion 19 similarly contact shingles such as shingle 24 on roof 3 (FIG. 1).

More particularly, with reference to FIG. 4, generally V-shaped baffles such as baffles 50 and 51 shown are integrally formed with panel portion 17. The baffles downwardly depend from panel portion 17 to support panel portion 17 on the roof. Generally V-shaped baffles such as baffles 52, 53 and 54 are integrally formed with panel portion 19 and they downwardly depend from panel portion 19 to support panel portion 19 on the adjacent roof portion. The generally V-shaped baffles such as 50 and 51 are positioned longitudinally along the dimension designated by reference character 56, in FIG. 4, along panel portion 17, for example, in an overlapping sinusoidal pattern such that they provide a substantially continuous barrier longitudinally along the ridge vent 5 to resist wind-driven rain or snow from entering through ventilation openings 61 which are described in detail hereinafter. A similar pattern of baffles such as baffles 52, 53 and 54 is provided on panel portion 19. It should be understood that the baffles could take other shapes while remaining within the scope of the present invention.

Referring now to the dimensions of the ridge vent 5, the overall width of ridge vent 5 is designated by reference character 58 in FIG. 4. This width is preferably between about 10 and 13 inches, and most preferably, between about 11 and 12 inches. Each ridge vent 5 is preferably about four feet in length. The ridge vents may, of course, be of any suitable length, however, it is preferred to provide four foot panels in order to accommodate a variety of building sizes and for convenience of use and assembly, as well as of manufacture. It is also preferred to provide panels having a transverse width in plan of between about twenty percent to thirty percent of the axial length of the ridge vent 5.

Referring still to FIG. 4, the dimensions of the V-shaped baffles, such as baffle 54 will be discussed. The length of each side wing designated by reference character 60 of baffle 54 is most preferably about 0.5 inches. The thickness designated by reference character 62 of each side wing of a baffle 54 is typically about 0.125 inches. The height of the generally V-shaped baffles such as baffle 54 is preferably about 0.9 inches. This height provides a low profile that blends with the roof for an aesthetically pleasing appearance.

Ridge vent 5 is also provided with generally and substantially downwardly depending ventilation ribbing 57 on panel portion 17 and ventilation ribbing 55 on panel portion 19. (FIGS. 1 and 4). Ribs such as ribs 59 and 61 shown in FIG. 4 are preferably about 0.125 inches in width and they have an opening 63 therebetween to allow air to pass through. Opening 63 is preferably about 0.125 inches in width and is preferably about 1.37 inches in length. The ventilation ribbing 57 and 55 provides structural support while allowing air to pass through the openings defined between ribbing 57 and 55. Opening 63 may be of any suitable dimension, however, the openings are preferably small enough to resist insects or animals from gaining access to the opening 4 in the building. The dimensions of ribs 59 and opening 63, for example, are chosen to provide a usable net free area in excess of about 16 square inches per lineal foot of the ridge vent 5 which is desirable in residential dwelling requirements.

Figure 5:
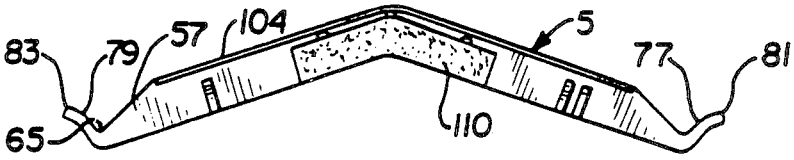
FIG. 5 is an end elevation of the ridge vent of FIG. 2.

Referring to FIGS. 3 and 5, the ventilation features of the present invention also include flange 79 on panel portion 17 and flange 77 on panel portion 19. Flanges 77 and 79 are angled generally outwardly and generally upwardly so as to deflect wind up and over the ridge of roof 3. In so doing, negative pressure is created to draw air from the attic or building and to increase ventilation. Preferably the overall angle "A" between flange 77 and ventilation ribbing 55 on panel portion 19 (FIG. 3) is between about 30 and 60 degrees and is preferably about 45 degrees.

Referring to FIG. 5, flange 77 may also have an outwardly extending lip 81 and flange 79 may have outwardly extending lip 83 to facilitate further deflection of wind up and over the roof ridge. Outwardly extending lips 81 and 83 are generally angled further outwardly about an additional 15 degrees. The lips 81 and 83 aid in directing wind up and over the vent and lips 81 and 83 disrupt wind-driven rain or snow so as to resist weather infiltration of the attic space.

Referring to FIGS. 1 through 4, the drainage system of the present invention will be described. The drainage system is described with respect to panel portion 17, but it should be understood that a similar drainage assembly is also included at panel portion 19 of ridge vent 5. Panel portion 17 has generally and substantially downwardly depending ribbing 57 (FIG. 4). In addition, panel portion 17 has generally outwardly and upwardly extending flange 79 (FIG. 5). Flange 79 extends outwardly from the base of ribbing 57 and a gutter member 65 is integrally formed between ribbing 57 and flange 79.

More specifically, at the base of ventilation ribbing 57, a narrow flat portion forms a gutter member 65 (FIG. 2) which runs along the length of vent panel 5. Gutter member 65 is co-planar with the base of the V-shaped baffles and it rests directly on the shingles on roof 3. A similar gutter member 65 is provided adjacent ventilation ribbing 55 and it runs along panel portion 19 on the opposite side of the ridge vent 5. Drainage openings such as openings 71, 73 and 75, shown in FIG. 2, are provided in flange 77, for example, adjacent ribbing 55. A plurality of such drainage openings are placed in flange 77 on panel portion 19 of ridge vent 5 and in flange 79 on panel portion 17 on the opposite side of ridge vent 5. Water which rolls down capping shingles 28 and 29 falls into gutter member 65, for example. The drainage holes such as holes 71, 73 and 75 provide drainage for the water which is collected in gutter 65 thereby allowing the water to drain through the holes out of the gutter 65 and to roll down roof 3 along shingle 49. This draws water and snow and other precipitation away from the opening 4 in roof 3 and away from internal portions of the ridge vent 5. In addition, as the generally V-shaped baffles 25 provide an open base such that the ridge vent 5 does not have a continuous floor member, any water which does escape into the area underneath ridge vent 5, can still roll down shingle 49 away from the opening in the roof. This resists water or moisture from collecting between ridge vent 5 and the underlying shingles.

Figure 6:
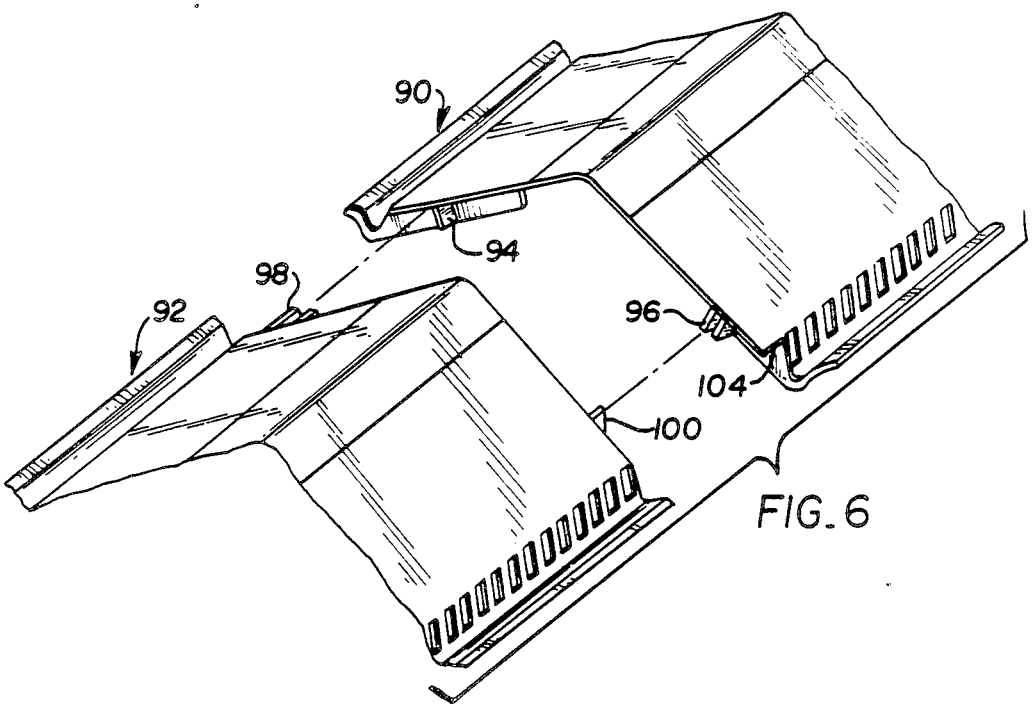
FIG. 6 is an exploded view of two adjacent ridge vents showing the alignment tabs for connecting two the ridge vents together in accordance with the present invention.

The present invention also provides a means for connecting adjacent or contiguous ridge vents together, in a friction-fit manner. Any suitable means for friction-fitting the ridge vents together may be employed. However, it is preferred to provide the connection system shown in FIG. 6 in which vent panel 90 is to be connected to vent panel 92. In the exemplary embodiment, vent panel 90 is provided with male alignment tab member 94 and female receiving members 96. Similarly, ridge vent 92 has female receiving members 98 and male alignment member 100. The alignment tabs 98 and 100 of ridge vent 92 are in the opposite configuration to those of ridge vent 90 so as to provide a corresponding frictional relationship. For example, female receiving member 96 of ridge vent 90 friction fits with male alignment member 100 of ridge vent 92. Similarly, male alignment tab 94 is received in frictional engagement within female receiving alignment members 98 of ridge vent 92. In this way, two adjacent ridge vents such as 90 and 92 are aligned and connected together in mating relationship with one another to secure the ridge vents together. It should be understood that other configurations of alignment tabs could be used while remaining within the scope of the present invention.

To provide additional support between connected vent panels and to resist water from flowing between two connected panels, such as 90 and 92, an extension member 104 is provided. Extension member 104 is also visible in FIG. 2. Extension member 104 extends between about 0.2 and 0.5 inches beyond the end of panel 5 and it extends preferably about 0.375 inches in the distance it extends out from panel 5. The extension member 104 protrudes out substantially the same distance as the alignment tabs on ridge vent 92. No extension member exists over the opposite alignment tabs. Therefore, when the two sets of alignment tabs are fitted together, one extension member 104 covers the gap between panels and a smooth effect is created between the two connected vents 90 and 92. The extension member which is provided on only one end of ridge vent 5 is integrally formed as part of the ridge vent 5. Extension member 104 covers the alignment tabs and adds continuous support between vent panels. Additionally, extension member 104 resists water and any additional weather from entering between two connected ridge vents. It should be understood that a uniform vent panel 5 can be used for the entire roof because all of the aforementioned connection features are included on each vent panel. Therefore, only one type of panel is required to be manufactured or purchased for use.

It is preferred to construct the vent of a material selected from the group consisting of polypropylene, polyethylene and polyvinyl chloride. It is presently most preferred to construct the vent of polypropylene with U.V. inhibitors as would be understood by those skilled in the art. The U.V. inhibitors are formulated into the material to resist degradation due to ultraviolet radiation exposure. Alternative materials for the vent panel include high density linear polyethylene and polyvinylchloride. A suitable material for the U.V. inhibitors would be carbon black or a U.V. stabilizer which would be readily available to those skilled in the art. The vent panel material is chosen based upon its ability to resist warping and wear due to weather, to reduce cost and to provide ease of manufacture. The ridge vent may be constructed as a unitary piece of molded plastic, or it can be constructed of various members which are thereafter secured together. It is preferred to construct the ridge vent of molded plastic.

Figure 7:
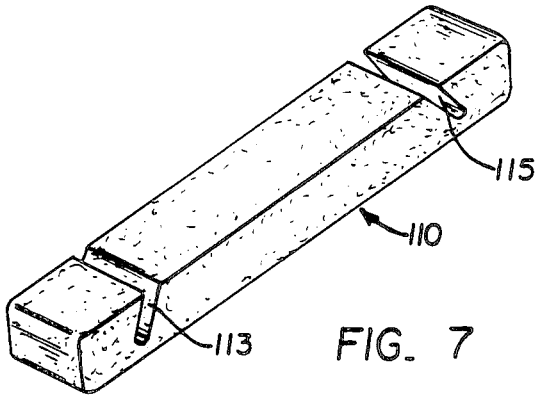
FIG. 7 is an isometric drawing of the end plug of the present invention.
Figure 8:
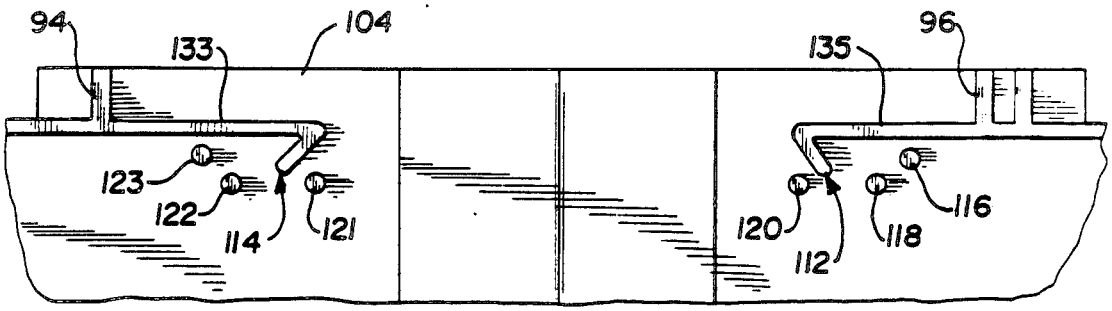
FIG. 8 is an enlarged view of the plug retaining subassembly which is integrally formed in each ridge vent.

For the endmost ridge vents, which are placed at either end of a roof, a foam plug 110 is provided to resist weather, wind, insects, birds and the like, from entering into the opening 4 in the roof 3 under the ridge vent 5. Foam-cell plug 110 is shown in FIG. 7. Foam-cell plug 110 is a preformed piece of foam material which is held in ridge vent 5 by the fastening assembly shown in FIG. 8. Angled receiving members 112 and 114 are provided to engage pockets 113 and 115 in plug 11. (FIG. 7). Pins 116, 118 and 120 secure one end of plug 110 while pins 121, 122 and 123 hold the opposite end. (FIG. 8). Preferably, a set of the angled receiving members such as 112 and 114, and the retaining pins are provided at each one-foot interval along each vent panel 5. For example, an assembly of such pins and angled members are designated by reference character 130 in FIG. 4. This allows a ridge vent to be cut at any one-foot interval and this shorter member can then serve as the end most vent panel to accommodate roofs of any length. In order to further facilitate use of the ridge vent which is cut to a shorter length, additional closure members, such as 132 and 134 as shown in FIG. 4, are provided. These additional closure members and the foam plug 110 act to close off the endmost ridge vent. The alignment tabs, of course, are not necessary at such points because this panel would serve as the end of the overall vent assembly and would not be connected to a contiguous panel vent.

Each vent panel 5 may be installed on a roof by nailing it from above, passing the nail through the vent panel, through underlying shingles 49, and into the underlying plywood decking of the roof. Tubular members with receiving bores, such as members 117 and 119 of FIG. 4, are provided to receive and support the nails which fasten the vent 5 to the roof 3. Tubular members 117 and 119 are integrally formed as part of ridge vent 5.

After vent 5 is secured to the roof 3, capping shingles, such as shingles 28 and 29 (FIG. 1), are affixed to the panel 5 in the standard manner as would be understood by those skilled in the art.

It is also noted that a screen 182 (FIG. 3) may be placed underneath the vent panel 5 to provide additional protection against insects and the like from entering the building. The screen is preferably a wire mesh with an opening size of not less than one-eighth inch nor more than one-quarter inch.

Figure 9:
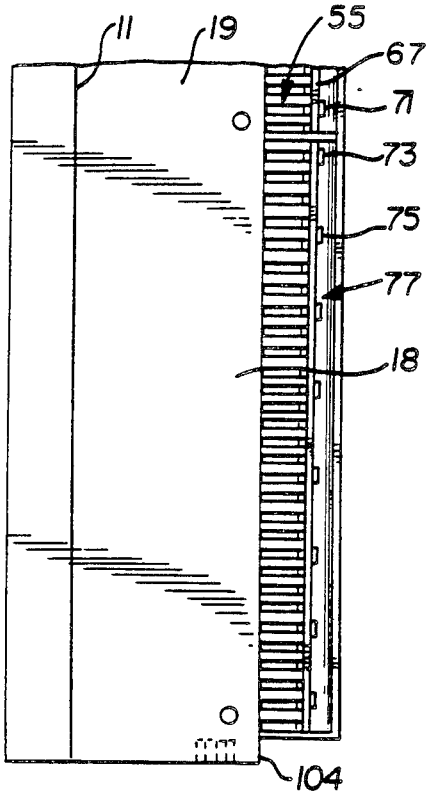
FIG. 9 is a top plan view of the flashing-type ridge vent of the present invention.
Figure 10:
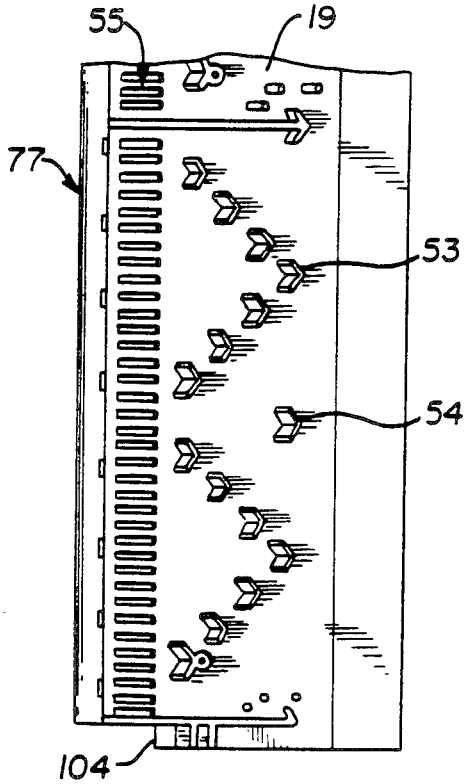
FIG. 10 is a bottom plan view of the flashing-type ridge vent of the present invention.
Figure 11:
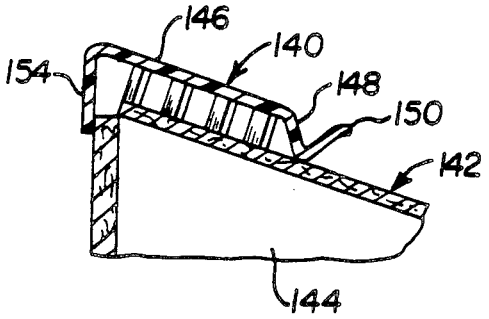
FIG. 11 is a side section of the flashing-type ridge vent mounted on a downward half-ridge roof.

In accordance with another aspect of the invention, the ridge vent may be used as a flashing-type vent on a half-ridge roof. Referring to FIGS. 9 and 10, the flashing-type vent 140 is shown in top and bottom plan views, respectively. The flashing-type vent 140 is created by simply cutting the ridge vent 5 along one of the hinges such as hinge 11. In this way, only panel portion 17 is used without panel portion 19. For example, the flashing-type vent 140 is placed over shingle 142 on a downward half-ridge roof 144. The flashing-type vent 140 has web portion 146 and ventilation section 148 which is a section of ribbing and openings provided in the manner described hereinbefore with respect to the full ridge vent. Flashing-type vent 140 is also provided with integrally formed flange 150 to facilitate upward deflection of wind. Flange 150 may have lip 152 provided thereon. As shown in FIG. 11, the flashing-type vent 140 also has an integrally formed extension member 154, which engages the end of the building on, for example, a single-peaked roof. Capping shingles (not shown) may also be applied in the manner which would be understood by those skilled in the art.

Figure 12:
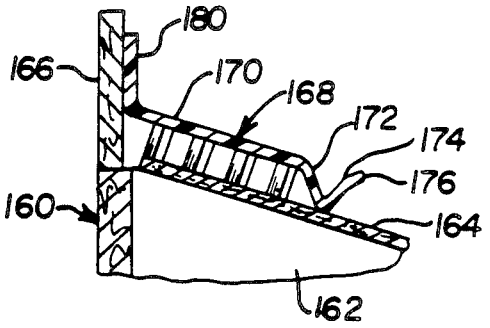
FIG. 12 is a side section of the flashing-type ridge vent mounted on an upward half-ridge roof.

In accordance with another aspect of the invention, the flashing-type vent may be used with an upward half-ridge roof such as a lean-to or shed-type roof. Referring to FIG. 12, upward half-ridge roof 160 has sloped area 162 and which is covered with shingle 164. Roof section 160 abuts against vertical wall 166. A flashing-type vent 168 is placed over roof 160 and it contacts vertical wall 166 as shown in FIG. 12. Flashing-type vent 168 has web portion 170 and ventilation section 172 which has ribbing and openings in the same configuration as hereinbefore described. In addition, flashing-type vent 168 has flange 174 which may additionally have lip 176. As discussed hereinbefore, flange 174 deflects wind upward and away from the roof. Flashing-type ridge vent 168 also has contact area 180 which abuts directly against vertical wall 166 and may be nailed directly thereto if desired. As noted hereinbefore with respect to other embodiments of the invention, capping shingles would also typically be installed over the flashing-type vent 168 in a conventional manner.

It should be appreciated that the present invention provides a universal ridge vent panel which can be adapted for use with any roof. In addition, the invention may be adapted to be used with a half-ridge roof. The roof ventilation system is economical and easy to use and provides great versatility.

Whereas particular embodiments of the present invention have been described above for purposes of illustration, it will be appreciated by those skilled in the art that numerous variations of the details may be made without departing from the invention as described in the appended claims.

What is claimed is:

1. A ridge vent for covering the opening at the peak of a roof, comprising:

a first panel portion and a second panel portion joined to form an inverted generally V-shaped web portion having two opposed lateral edges and two opposed ends, each said panel portion having a cover surface facing towards the atmosphere and an interior surface adapted to face said roof;

ventilation means having a plurality of openings defined on a plurality of support ribs, said support ribs being disposed generally adjacent each lateral edge of said web portion and extending generally downwardly from each said lateral edge of said web portion, and each said ventilation means having an upwardly and outwardly extending flange means for deflecting wind over said ridge vent and creating negative air pressure; and support means depending from said interior surface of each said panel portion for contacting said roof.

2. The ridge vent of claim 1 wherein said ventilation means is composed of said plurality of support ribs extending generally downwardly from each said lateral edge of said web portion, said support ribs being disposed adjacent to and defining said openings.

3. The ridge vent of claim 2 further comprising drainage means composed of elongated gutter means disposed between said support ribs and said flange means forming a path along which water may flow.

4. The ridge vent of claim 3 wherein said gutter means is integrally formed between said support ribs and said flange means.

5. The ridge vent of claim 4 wherein said drainage means also has drain openings in said flange means disposed generally adjacent said gutter means, whereby water flowing along said gutter means is discharged from said ridge vent through said drain holes.

6. The ridge vent of claim 1 wherein said support means includes a plurality of baffle means depending downwardly from said interior surface of each said panel portion said baffle means being of a length such that the free end of each said baffle means engages said roof.

7. The ridge vent of claim 6 wherein said baffle means are disposed on said interior surface of each said panel portion such that said baffle means are in an overlapping configuration to one another along the longitudinal length of each panel portion to create a substantially continuous barrier against precipitation entering under said panel portion through said ventilation means, while allowing air to pass between said baffle means.

8. The ridge vent of claim 7 wherein said baffle means are disposed on each said panel portion in a generally sinusoidal pattern such that a substantially continuous barrier is created along said longitudinal length of each said panel portion.

9. The ridge vent of claim 7 wherein said baffle means are generally V-shaped members.

10. The ridge vent of claim 1 further comprising connection means comprising first alignment means disposed at one of said ends of said ridge vent, and second alignment means disposed at the other end of said ridge vent, and said first and second alignment means being of corresponding configuration such that said second alignment means will fit together in frictional mating relationship with a first alignment means on an adjacent ridge vent.

11. The ridge vent of claim 10 wherein said first alignment means is composed of a set of first alignment tabs, one of said first alignment tabs being a male alignment member and the other of said first alignment tabs being a female receiving member, and said second alignment means is composed of a set of second alignment tabs, one of said second alignment tabs being a female receiving member and the other of said second alignment tabs being a male alignment member, said male and female members of said first and second sets being disposed in an opposite configuration such that said first alignment tabs on said ridge vent will frictionally fit in corresponding mating relationship with said second alignment tabs on an adjacent vent.

12. The ridge vent of claim 11 wherein said connection means also comprises an extension member protruding above one of said sets of alignment tabs such that when said ridge vent is connected to said adjacent ridge vent said extension member extends to overlap and cover said connected alignment tabs to close a gap between said connected ridge vents.

13. The ridge vent of claim 10 further comprising plug means received within at least a portion an exterior-facing portion of an endmost ridge vent to resist precipitation and foreign bodies from entering the opening in said roof at said endmost ridge vent.

14. The ridge vent of claim 1 wherein said vent is composed of a material selected from the group consisting of polypropylene, polyethylene and polyvinylchloride.

15. The ridge vent of claim 14 wherein said material also includes an ultraviolet inhibitor.

16. The ridge vent of claim 1 wherein said web portion also has hinge means for adjusting the angle between said first panel portion and said second panel portion at which said web portion is bent to cover said opening.

17. A ridge vent for covering the opening at the peak of the roof, comprising a first panel portion and a second panel portion joined to form an inverted generally v-shaped web portion having two opposed lateral edges and two opposed ends, each said panel portion also having a cover surface facing towards the atmosphere and an interior surface adapted to face said roof;

ventilation means having a plurality of openings disposed generally adjacent each lateral edge of said web portion and extending generally downwardly from each said lateral edge of said web portion towards said roof; and a plurality of spacer means depending from the internal surface of each said panel portion, and said spacer means for contacting said roof and said spacer means being configured to provide a substantially continuous longitudinal barrier for resisting entry of precipitation at each lateral edge of said ridge vent while allowing air to circulate between said spacer means.

18. The ridge vent of claim 17 wherein said spacer means on each said panel portion are laterally spaced apart from one another but longitudinally overlapping to allow air to pass through spaces between said spacer means while providing a substantially continuous longitudinal barrier along each lateral edge of said vent.

19. The ridge vent of claim 18 wherein said spacer means are generally V-shaped baffle means.

20. The ridge vent of claim 19 wherein said baffle means are disposed on each said panel portion in a generally sinusoidal pattern.

21. The ridge vent of claim 18 further comprising ventilation means disposed generally adjacent each lateral edge of said ridge vent, each said ventilation means having a downwardly depending set of rib means defining openings therebetween.

22. The ridge vent of claim 21 wherein said ventilation means also has an upwardly and outwardly extending flange means for deflecting wind over said ridge vent and for creating negative air pressure.

23. The ridge vent of claim 22 wherein said ventilation means also has drainage means for facilitating drainage of water from said ridge vent, said drainage means comprising elongated gutter means integrally disposed between said rib means and said flange means, and said flange means having drain holes disposed therein generally adjacent to said gutter means, whereby water flowing along said gutter means is discharged from said ridge vent through said drain holes.

24. The ridge vent of claim 23, further comprising connection means comprising first alignment means disposed at one of said ends of said ridge vent and second alignment means disposed at the other end of said ridge vent, said first and second alignment means disposed at the other end of said ridge vent, and said first and second alignment means being of corresponding configuration such that said first and second alignment means will frictionally fit together in corresponding mating relationship with said alignment means on an adjacent ridge vent.

25. A roof ventilation system for an opening at the peak of the roof of a building, comprising an interconnected set of vent panels, said set of vent panels disposed along an opening at the peak of said roof for contacting said roof, and each said vent panel having two opposed lateral edges and two opposed ends and a center web portion composed of two connected panel portions, said vent having hinge means for conforming said panel portions to said opening of said roof, and each said panel portion having a cover surface facing the atmosphere and an interior surface facing said roof;

ventilation means disposed on each said panel portion, said ventilation means extending downwardly from each said panel portion to said roof; and flange means adjacent to each said ventilation means for directing air flow upward and creating negative air pressure such that air is drawn from said building; and support means disposed between each said panel portion and said roof and contacting said roof.

26. The ventilation system of claim 25 wherein said flange means are disposed adjacent said ventilation means such that said flange means extend upwardly and outwardly and an angle therebetween being between about 30 and 60 degrees.

27. The ventilation system of claim 25 wherein each said vent panel has connecting means comprising first alignment means disposed at one of said ends of said vent panel, and a second alignment means disposed at the other end of said vent panel, and said second alignment means being of corresponding configuration such that said second alignment means will frictionally fit together in corresponding mating relationship with said first alignment means on an adjacent ridge vent.

28. The ventilation system of claim 27 wherein said connection means also has a first set of alignment tabs disposed at one end of said vent panel, said alignment tabs being composed of a first male tab member and a first female receiving member, and said connection means also being composed of a second set of alignment tabs disposed at another end, said second set of alignment tabs being composed of a second male tab member and a second female receiving member disposed in an opposite configuration to that of said first set of alignment tabs such that said first male tab member of said first set of alignment tabs on one vent panel is frictionally engaged by said second female receiving member on a second set of alignment tabs on a next adjacent vent panel to secure each vent panel in locking relation with an adjacent vent panel.

29. The ventilation system of claim 27 wherein said connecting means also has an extension member disposed at one end of each said vent panel, for closing a gap between two contiguous vent panels.

30. The ventilation system of claim 25 wherein each said vent panel also has plug retainer means disposed at both ends thereof and at predetermined intervals along the length of said vent panel, said retainer means being composed of angled securement means disposed on opposite sides of said hinge means, and a plurality of pin means positioned at predetermined locations around said angled securement means.

31. A roof ventilation system for an opening at the peak of the roof of a building, comprising an interconnected set of vent panels, said set of vent panels disposed along an opening at the peak of said roof for contacting said roof, and each said vent panel having two opposed lateral edges and two opposed ends and a center web portion composed of two connected panel portions, said vent having hinge means for conforming said panel portions to said opening of said roof, and each said panel portion having a cover surface facing the atmosphere and an interior surface facing said roof;

ventilation means disposed on each said panel portion, said ventilation means extending downwardly from each panel portion to said roof;

flange means disposed adjacent said ventilation means such that said flange means extend upwardly and outwardly and an angle therebetween being between about 30 and 60 degrees;

connecting means disposed on each vent panel, each connecting means comprising first alignment means disposed at one end of said ends of said vent panel, and a second alignment means disposed at the other end of said vent panel and said second alignment means being of corresponding configuration such that said second alignment means will frictionally fit together in corresponding mating relationship with said first alignment means on an adjacent ridge vent;

extension member disposed at one end of each said vent panel, for closing a gap between two contiguous vent panels;

plug retainer means disposed at both ends of each said vent panel and at predetermined intervals along the length of said vent panel, said retainer means being composed of angled securement means disposed on opposite sides of said hinge means, and a plurality of pin means positioned at predetermined locations around said angled securement means; and plug means disposed at each end of said ventilation system in the outwardly facing end-most vent panel, said plug means being sized to be received into said angled securement means and having slot means therein adapted to be engaged by said angled securement means.

32. The ventilation system of claim 31 wherein said plug means is composed of a closed-cell foam material.

33. The ventilation system of claim 25 wherein said vent panels have a plurality of tubular receiving bores disposed along said web portion, at least one of said receiving bores being provided generally adjacent each corner of each said vent panel.

34. The ventilation system of claim 33 further comprising fastening means associated with each vent panel for securing said vent panel to said roof, said fastening means being received through said receiving bores of said associated vent panels.

35. The ventilation system of claim 34 in combination with a shingled roof, wherein said vent panels are secured to shingles in said roof by said fastening means being passed through said receiving bores in said vent panels, into said shingles and into said roof.

36. The ventilation system of claim 35 further comprising capping shingles secured over said web portion of each said vent panel.

37. The ventilation system of claim 25 further comprising screen means placed across said opening of said roof and over which said vent panels are disposed.

38. A flashing vent for use with a sloped roof portion of a building comprising a generally flat web portion having a plurality of generally v-shaped baffle means disposed on a side of said web portion facing said roof, said v-shaped baffle means for contacting said roof portion and said v-shaped baffle means overlapping in longitudinal configuration to resist infiltration of weather and other foreign bodies into said building; and ventilation means disposed on one end of said flashing vent, said ventilation means being composed of spaced apart ribbing members angled downwardly from said web portion towards said roof portion.

39. The flashing vent of claim 38 further comprising gutter means disposed generally along one end of said ventilation means; and flange means disposed adjacent said gutter means and angled upwardly for directing air up and over said flashing vent, and said flashing means also having a plurality of openings therethrough to allow moisture collected in said gutter means to drain from said flashing vent.

40. The flashing vent of claim 39 wherein said web portion also has a plurality of tubular receiving bores for receiving fastening means to secure said flashing vent to said roof portion.

41. The flashing vent of claim 39 in combination with a downward half-ridge roof further comprising a generally flat contact portion disposed adjacent another end of said web portion opposite to said ventilation means, said contact portion angled downwardly from said web portion to contact a side portion of said roof.

42. The flashing vent of claim 39 in combination with an upward half-ridge roof adjacent a vertical wall of a building, further comprising a generally flat contact portion disposed adjacent another end of said web portion opposite to said ventilation means, said contact portion angled upwardly from said web portion to contact said vertical wall of said building.

* * * * *